US006250257B1

(12) United States Patent
Kastner et al.

(10) Patent No.: US 6,250,257 B1
(45) Date of Patent: Jun. 26, 2001

(54) METHOD FOR OPERATING A ONCE-THROUGH STEAM GENERATOR AND ONCE-THROUGH STEAM GENERATOR FOR CARRYING OUT THE METHOD

(75) Inventors: Wolfgang Kastner, Herzogenaurach; Wolfgang Köhler, Kalchreuth; Eberhard Wittchow, Erlangen, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/306,175

(22) Filed: May 6, 1999

Related U.S. Application Data

(63) Continuation of application No. PCT/DE97/02479, filed on Oct. 24, 1997.

(30) Foreign Application Priority Data

Nov. 6, 1996 (DE) ..... 196 45 748

(51) Int. Cl.[7] ..... F22B 37/34

(52) U.S. Cl. ..... 122/406.4; 122/1 B; 122/6 A; 122/235.12; 122/451 S

(58) Field of Search ..... 122/1 B, 6 A, 122/236.12, 367.3, 406.4, 451 S

(56) References Cited

U.S. PATENT DOCUMENTS

| | | | | |
|---|---|---|---|---|
| 4,987,862 | * | 1/1991 | Wittchow et al. | 122/235.12 |
| 5,662,070 | * | 9/1997 | Kastner et al. | 122/6 A |
| 5,706,766 | * | 1/1998 | Koehler | 122/6 A |

FOREIGN PATENT DOCUMENTS

| | | |
|---|---|---|
| 20 32 891 | 2/1971 | (DE) . |
| 43 33 404 A1 | 4/1995 | (DE) . |
| 0 503 116 B2 | 9/1992 | (EP) . |
| 1 288 755 | 2/1962 | (FR) . |

OTHER PUBLICATIONS

R. Kral et al., 4556 VGB Kraftwerkstechnik, 73 (1993) Sep., No. 9, Essen, Germany, Experiments with a Benson®–evaporator having a vertical tube in a 160–t/h–steam generator.

Evaporator draft for Benson®–steam generator, Franke et al., VGB Kraftwerkstechnik 73 (1993), vol. 4, pp. 352–361.

Juzi et al., VGB Kraftwerkstechnik 64 (1984), vol. 4, pp. 294–296 with Figs. 5–10, Forced through–flow boiler for variable–pressure operation having a vertical combusting chamber tube.

(List continued on next page.)

*Primary Examiner*—Gregory Wilson
(74) *Attorney, Agent, or Firm*—Herbert L. Lerner; Laurence A. Greenberg; Werner H. Stemer

(57) ABSTRACT

A once-through steam generator having a combustion chamber. A containing wall of the combustion chamber is formed from vertically disposed evaporator tubes welded to one another in a gas-tight manner. The combustion chamber is to be capable of being used safely and reliably in a pressure range of between about 200 bar and 221 bar, while, moreover, a particularly high efficiency is to be achieved. For this purpose, according to the invention, a mass flow density m of a flow medium has the following relationship $$m=200+8.42\cdot 10^{12}\cdot q^3[d/(d-2s)]s^2\cdot T_{max}^{-5}$$

in the evaporator tubes. In this case, q is the heat flow density acting on the evaporator tubes, $T_{max}$ is an admissible maximum temperature characteristic of the tube material, d is the outside diameter of the evaporator tubes and s is the wall thickness of the evaporator tubes.

8 Claims, 3 Drawing Sheets

OTHER PUBLICATIONS

New types of boilers manufactured by Mitsubishi for supercritical– and ultra/supercritical–pressure power–generating units, I. E. Semenovker, Thermal Engineering vol. 41, No. 8, 1994, pp. 655–661.

Industrial know–how at the power plant Meppen, G. Knisel, EVT–index 29, 1975, pp. 25–31.

600 MW–block power plant Meppen, Bürkle, EVT–index 21, 1971, pp. 7–14.

Problems in the arrangement of forced flow steam generators, V. Linzer et al., EVT–index 23/74, 1974, pp. 1–20 with figures 1–24 and tables 1–3.

Almanac of technical steam generating, vol. 1, $5^{th}$ issue 1985/86, VGB Technische Vereinigung der Grosskraftwerksbetreiber e. V. et al., Vulkan–Verlag Essen, pp. 234–242 and 332–342.

* cited by examiner

METHOD FOR OPERATING A ONCE-THROUGH STEAM GENERATOR AND ONCE-THROUGH STEAM GENERATOR FOR CARRYING OUT THE METHOD

CROSS REFERENCE TO RELATED APPLICATION

This application is a continuation of International Application PCT/DE97/02479, filed Oct. 24, 1997, which designated the United States.

BACKGROUND OF THE INVENTION

Filed of the Invention

The invention relates to a method for operating a once-through steam generator having a combustion chamber. The containing wall of which is formed from vertically disposed evaporator tubes welded to one another in a gas-tight manner and a flow medium flowing through the evaporator tubes. It relates, further, to a once-through steam generator for carrying out the method. A steam generator of this type is known from the article "Verdampferkonzepte für Benson-Dampferzeuger"["Evaporator Concepts for Benson Steam Generators"] by J.Franke, W. Köhler and E. Wittchow, published in VGB Kraftwerkstechnik 73 [VGB Power Station Technology 731(1993), issue 4, pages 352–360. In the case of a once-through steam generator, the heating of the evaporator tubes forming the combustion chamber or the gas flue leads to the flow medium evaporating in the evaporator tubes in a single pass. In contrast, a natural-circulation or forced-circulation steam generator has only partial evaporation of the circulated water/steam mixture. In this case, the evaporator tubes of the once-through steam generator may be disposed vertically or spirally and therefore at an inclination.

In contrast to a natural-circulation steam generator, a once-through steam generator is not subject to any pressure limitation. Therefore, it is possible to have fresh-steam pressures well above the critical pressure of water ($P_{crit}$=221 bar), where there is only a slight density difference between the liquid-like and steam-like medium. A high fresh-steam pressure is conducive to high thermal efficiency and therefore low $CO_2$ emissions of a fossil-heated power station. A once-through steam generator, the gas flue of which is composed of vertically disposed evaporator tubes, can be produced more cost-effectively than a spiral version.

Furthermore, once-through steam generators with vertical tubing have lower steam-side pressure losses, as compared with those having evaporator tubes that are inclined or are disposed so as to ascend spirally.

A once-through steam generator having a combustion chamber, the containing wall of which is formed from vertically disposed evaporator tubes welded to one another in a gas-tight manner, is known from Published, Non-Prosecuted German Patent Application DE 43 33 404 Al.

A particular problem is to configure the gas-flue or the combustion-chamber wall of the once-through steam generator to allow for the tube-wall or material temperatures occurring there. In the sub-critical pressure range up to about 200 bar, the temperature of the combustion-chamber wall is determined essentially by the value of the saturation temperature of the water when it is possible to ensure wetting of the heating surface in the evaporation region. This is achieved, for example, by using evaporator tubes which have a surface structure on their inside. Internally ribbed evaporator tubes come under consideration particularly for this purpose, the use of these in once-through steam generators being known, for example, from Published European Patent Application No. 0 503 116. These so-called ribbed tubes, that is to say tubes with a ribbed inner surface, have particularly good heat transmission from the tube inner wall to the flow medium.

In the pressure range of about 200 to 221 bar, the heat transmission from the tube inner wall to the flow medium decreases sharply, with the result that the mass flow density of the flow medium has to be selected correspondingly high, in order to ensure sufficient cooling of the evaporator tubes. For this purpose, the mass flow density must be selected higher in the evaporator tubes of once-through steam generators, which are operated at pressures of about 200 bar and above, than in the case of once-through steam generators which are operated at pressures of below 200 bar. However, a mass flow density increased in this way also results in a higher pressure loss in the evaporator tubes due to friction. As a consequence of this higher pressure loss due to friction, the advantageous property of vertical tubing, namely that, in the case of multiple heating of an individual evaporator tube, its throughput also rises, is lost, particularly in the case of small tube inside diameters. However, since steam pressures of above 200 bar are necessary for high thermal efficiency and low $CO_2$ emissions of a power station, it is necessary, in the pressure range too, to ensure good heat transmission from the tube inner wall to the flow medium. Once-through steam generators having a vertically tubed combustion-chamber wall are therefore normally operated at relatively high mass flow densities. In this respect, the publication "Thermal Engineering", I. E. Semenovker, Vol.41, No. 8, 1994, pages 655 to 661, uniformly specifies a mass flow density at 100% load of about 2000 kg/m$^2$s both for gas-fired and for coal-fired once-through steam generators.

SUMMARY OF THE INVENTION

It is accordingly an object of the invention to provide a method for operating a once-through steam generator and once-through steam generator for carrying out the method which overcome the above-mentioned disadvantages of the prior art methods and devices of this general type, which, along with safe and reliable cooling of the evaporator tubes, a particularly low pressure loss due to friction and therefore particularly high efficiency can be achieved. Moreover, a once-through steam generator particularly suitable for carrying out this method is to be specified.

With the foregoing and other objects in view there is provided, in accordance with the invention, an improved method for operating a once-through steam generator having a combustion chamber with a containing wall formed from vertically disposed evaporator tubes welded to one another in a gas-tight manner, the improvement which includes: conducting a flow medium through the evaporator tubes having a tube outside diameter d, a tube-wall thickness s, and an admissible maximum temperature $T_{max}$ defined by a material forming the evaporator tubes; and maintaining a mass flow density m of the flow medium flowing through the evaporator tubes as a function of a heat flow density q acting on the evaporator tubes, approximately at a control value according to the relation:

$$m=200+8.42\cdot10^{12}\cdot q^3\cdot[d/(d-2s)]s^2\cdot T_{max}^{-5}$$

As regards the method, the object is achieved, according to the invention, in that the mass flow density m of the flow medium is maintained, as a function of the heat flow density q acting on the evaporator tubes, approximately at a control value according to the relation:

$$m=200+8.42\cdot10^{12}\cdot q^3\cdot[d/(d-2s)]s^2\cdot T_{max}^{-5}$$

In this case, the heat flow density q on the tube outside in $kW/m^2$ is to be used in order to obtain the mass flow density m in $kg/m^2\cdot s$. Furthermore:

d signifies the outside diameter of the evaporator tubes in meters, s the tube-wall thickness of the evaporator tubes in meters, and $T_{max}$ the admissible maximum temperature in °C. characteristic of the tube material.

The invention proceeds, in this case, from the consideration that, when the once-through steam generator is in operation, safe and reliable cooling of the evaporator tubes, along with a particularly low pressure loss due to friction, is ensured by suitably satisfying two conditions which, in principle, are mutually contradictory. On the one hand, the mean mass flow density in the evaporator tubes must be selected as low as possible. It is thereby possible to ensure that a higher mass flow flows through individual evaporator tubes, to which more heat is supplied than to other evaporator tubes on account of unavoidable heating differences, than through averagely heated evaporator tubes. This natural-circulation characteristic known from the drum boiler leads, at the outlet of the evaporator tubes, to an equalization of the steam temperature and consequently of the tube-wall temperatures.

On the other hand, the mass flow density in the tubes must be selected so high that safe cooling of the tube wall is ensured and admissible material temperatures are not exceeded. High local overheating of the tube material and the damage (tube breaks) resulting from this are thereby avoided. The essential influencing variables for the material temperature are, in addition to the temperature of the flow medium, the outer heating of the tube wall and the heat transmission from the inner tube wall to the flow medium or fluid. There is therefore a relationship between the inner heat transmission, which is influenced by the mass flow density, and the outer heating of the tube wall.

With these boundary conditions being taken into account, the relation gives a particularly favorable mass flow density in the evaporator tubes which ensures both a favorable through flow characteristic (natural-circulation characteristic) and safe cooling of the evaporator tubes and therefore adherence to the admissible material temperatures. A criterion for determining a particularly favorable mass flow density is that, in the case of a predeterminable outer heating of the tube wall, the material temperature of the tube wall should be, on the one hand, only slightly below, but, on the other hand, safely below the admissible value. In this case, it is necessary to bear in mind the physical phenomenon whereby the heat transmission from the inner tube wall to the flow medium is at its most unfavorable in the critical pressure range of about 200 to 221 bar. The result of comprehensive tests is that the greatest material stress is reached when, in the evaporation region, a relatively low mass flow density is combined with the highest occurring heat flow density at a pressure of about 200 to 221 bar. This is the case, for example, in that region of the combustion chamber in which the burners are disposed. When the evaporation has subsequently ended and steam superheating commences, the material stress of the evaporator tubes of a combustion-chamber wall decreases again. The reason for this is that, in the case of a conventional burner configuration and a conventional combustion cycle, the heat flow density also decreases.

To determine a particularly favorable control value for the mass flow density m, a value determined according to the relation $$T_{max}=T_{crit}+6\sigma/(\beta\cdot E)$$

is expediently taken as a basis for the admissible maximum temperature $T_{max}$. In this case, $T_{crit}$ is the temperature of the flow medium at the critical pressure in °C. Furthermore, σ signifies the admissible stress in $N/mm^2$, β the coefficient of thermal expansion in 1/K, and E the modulus of elasticity of the material of the evaporator tubes in $N/mm^2$. In determining the admissible maximum temperature $T_{max}$, it is assumed that the containing or combustion-chamber wall of the once-through steam generator has a mean temperature which corresponds to the mean value of the admissible maximum temperature $T_{max}$ and the temperature of the flow medium at the critical pressure $T_{crit}$. The maximum thermal stress occurring is calculated from this as $$\sigma_{\max}=\frac{T\max-Tcrit}{2}\beta\cdot E$$

In the configuration of the once-through steam generator, the maximum thermal stress occurring should be fixed, according to the ASME Code, at three times the value of the stress σ admissible for the tube material. This results directly in the value to be taken as a basis for the admissible maximum temperature $T_{max}$.

It emerges from the configuration principles that, when a once-through steam generator, the evaporator tubes of which are manufactured from the material 13 CrMo 44, is in operation, a value of about $T_{max}$=515° C. is expediently taken as a basis for the admissible maximum temperature $T_{max}$. By contrast, when a once-through steam generator, the evaporator tubes of which are manufactured from the material HCM 12, is in operation, a value of about $T_{max}$=590° C. is advantageously taken as a basis for the admissible maximum temperature $T_{max}$.

As regards the once-through steam generator particularly suitable for carrying out the method, the object is achieved in that the once-through steam generator is configued, in the case of a heat flow density q acting on the evaporator tubes, for a mass flow density m according to the relation $$m=200+8.42\cdot10^{12}\cdot q^3\cdot[d/(d-2s)]s^2\cdot T_{max}^{-5}$$

Other features which are considered as characteristic for the invention are set forth in the appended claims.

Although the invention is illustrated and described herein as embodied in a method for operating a once-through steam generator and once-through steam generator for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
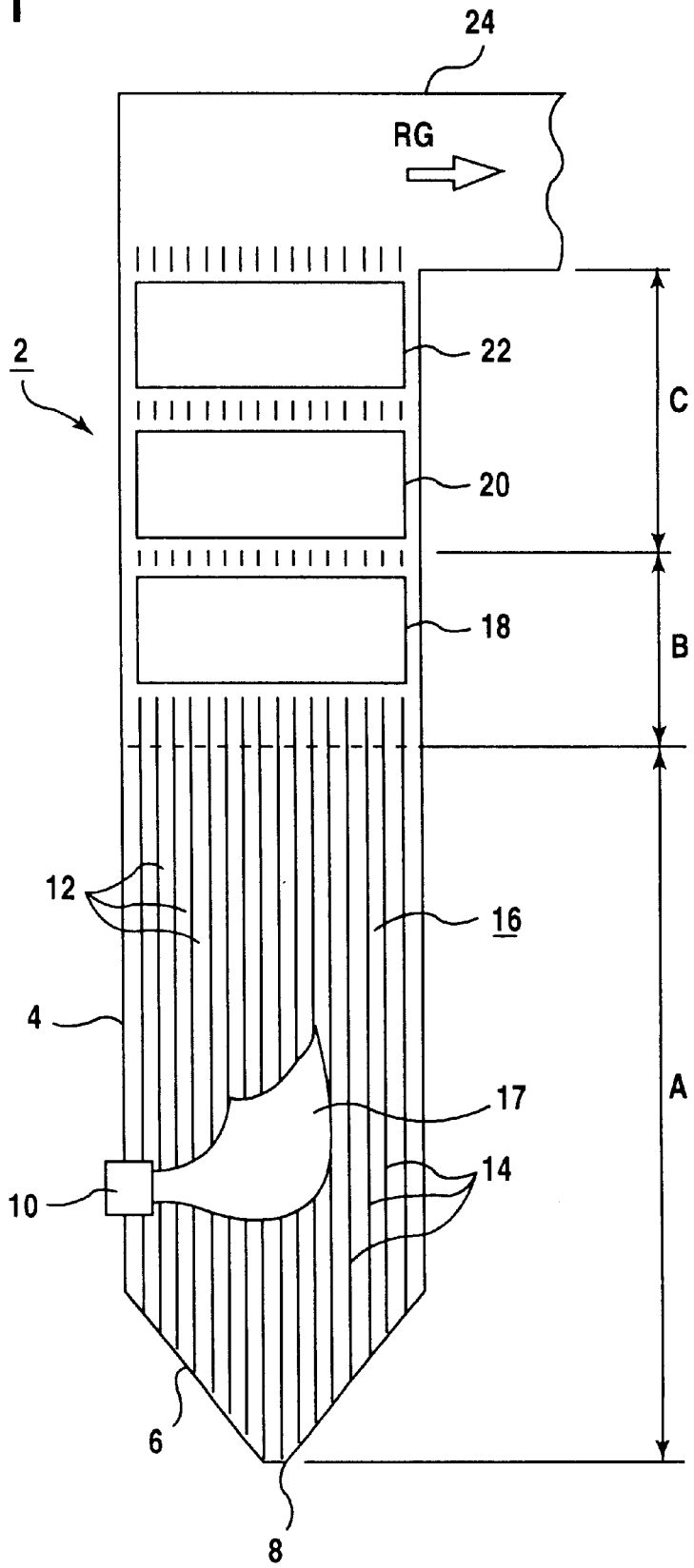
FIG. 1 is a diagrammatic, illustration of a once-through steam generator having vertically disposed evaporator tubes according to the invention.

In all the figures of the drawing, sub-features and integral parts that correspond to one another bear the same reference symbol in each case. Referring now to the figures of the drawings in detail and first, particularly, to FIG. 1 thereof, there is shown diagrammatically a once-through steam generator 2 of, for example, rectangular cross-section. A vertical gas flue of the steam generator is surrounded by a containing wall 4 and forms a combustion chamber which merges at the lower end into a funnel-shaped bottom 6. The bottom 6 contains an ash discharge orifice 8 not illustrated in any more detail.

In a lower region A of the gas flue, a number of burners 10, only one of which is shown, are mounted in the containing wall 4 of the combustion chamber, the containing wall 4 being formed from vertically disposed evaporator tubes 12. In this case, the burners 10 are configured for fossil fuel. The vertically disposed evaporator tubes 12 are welded to one another, in the region A, via tube webs or fins 14 to form the gas-tight containing wall 4. The evaporator tubes 12, through which the flow passes from the bottom upwards when the once-through steam generator 2 is in operation, form an evaporator heating surface 16 in the region A.

A flame body 17 occurring during the combustion of the fossil fuel is located in the combustion chamber when the once-through steam generator 2 is in operation, with the result that the region A of the once-through steam generator 2 is distinguished by a very high heat flow density q. The flame body 17 has a temperature profile which, starting from about the middle of the combustion chamber, decreases both in the vertical direction upwards and downwards and also in the horizontal direction towards the sides, that is to say towards the corners of the combustion chamber. Located above the lower region A of the gas flue is a second flame-distant region B, above which a third upper region C of the gas flue is provided. Convection heating surfaces 18, 20 and 22 are disposed in the regions B and C of the gas flue. Located above the region C of the gas flue is a flue-gas outlet duct 24, via which the flue gas RG generated as a result of the combustion of the fossil fuel leaves the vertical gas flue. The ratios illustrated in FIG. 1 for a once-through steam generator 2 of the single-draft type likewise apply comparably to a once-through steam generator of the twin-draft type.

Figure 2:
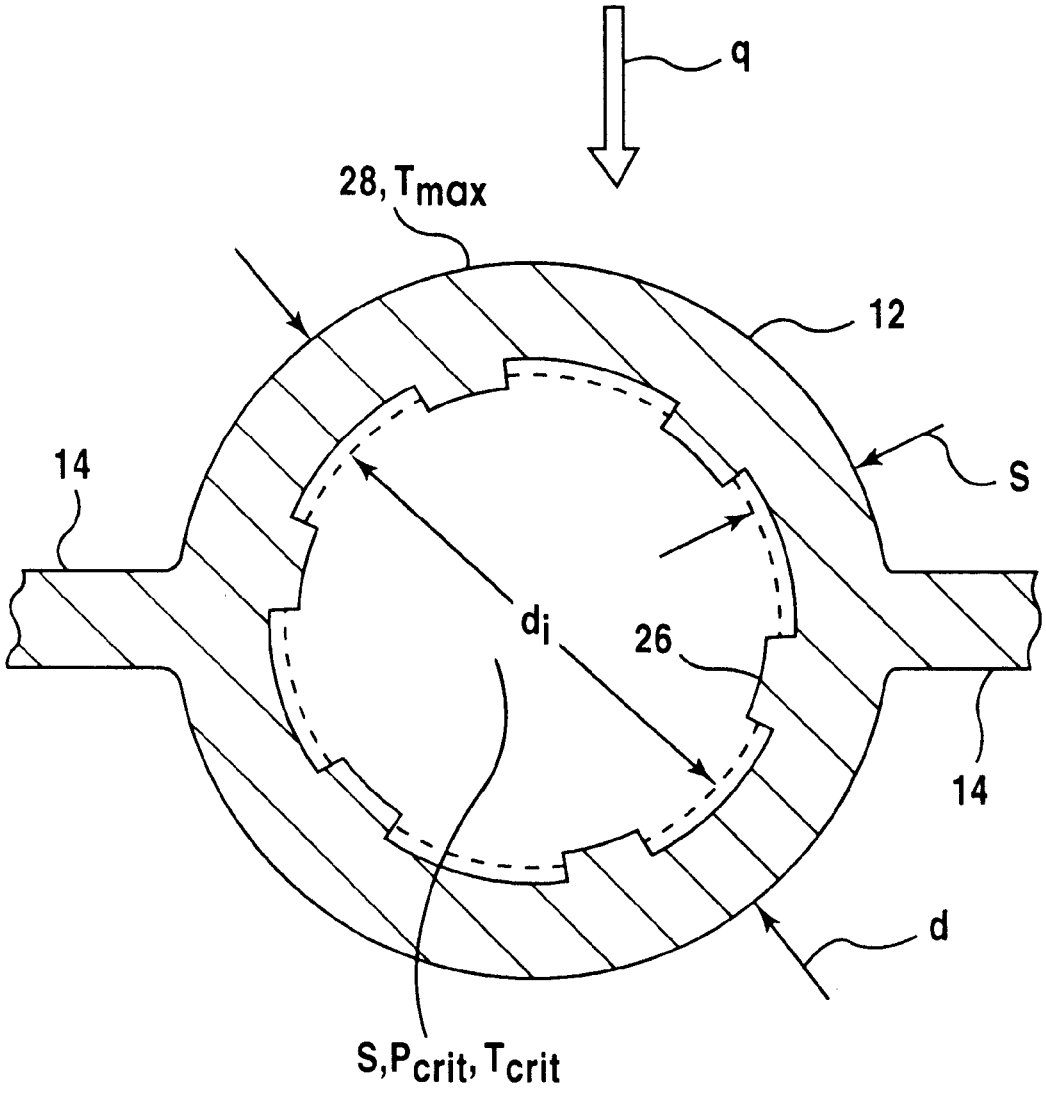
FIG. 2 is a sectional view of an individual evaporator tube.

FIG. 2 shows the evaporator tube 12 which is provided with ribs 26 on the inside and, while the once-through steam generator 2 is in operation, is exposed on the outside, within the combustion chamber, to heating at the heat flow density q and through which the flow medium S flows on the inside. For example, water or a water/steam mixture serves as the flow medium S.

At the critical point, that is to say at the critical pressure $p_{crit}$ of 221 bar, the temperature of the fluid or the flow medium S in the evaporator tube 12 is designated by $T_{crit}$. To calculate the maximum thermal stress $\sigma_{max}$, the maximum admissible material temperature $T_{max}$ at a tube vertex 28 on the heated side of the tube wall is used.

The inside diameter and the outside diameter of the evaporator tube 12 are designated by $d_i$ and d respectively. In the case of the internally ribbed evaporator tube 12, the equivalent inside diameter, which takes into account the influence of the rib heights and rib valleys, is to be used here as the inside diameter $d_i$. In this case, the equivalent inside diameter is that inside diameter that a smooth tube of the same flow cross-section would have. The tube-wall thickness is designated by s.

The once-through steam generator 2 is configured in such a way that, when it is operating, the mass flow density m of the flow medium S flowing through the evaporator tubes 12 is maintained approximately at a control value according to the relation:

$$m=200+8.42\cdot10^{12}\cdot q^3\cdot[d/(d-2s)]s^2\cdot T_{max}^{-5}$$

The mass flow density m in $kg/m^2\cdot s$ and the admissible maximum temperature $T_{max}$ in °C. are to be used in this case. Furthermore, the tube outside diameter d and the tube-wall thickness s in meters are to be used. A value given a safety margin is to be used as heat flow density q on the tube outside in $kW/m^2$. For this purpose, a value for a mean heat flow density is first determined from the technical data of the once-through steam generator 2, such as, for example, the cross-section of the combustion chamber, firing capacity, etc. A value for a maximum heat flow density is derived from the value for the mean heat flow density by multiplying by a safety factor. In this case, the safety factor is in the interval of 1.4 to 1.6 for coal firing and in the interval of 1.6 to 1.8 for lignite firing. The value to be used for the heat flow density q is formed by multiplying the maximum heat flow density by a further safety factor of 1.5. In other words: the value to be used for the heat flow density q is, for coal firing, 2.1 to 2.4 times and, for lignite firing, 2.4 to 2.7 times the mean heat flow density which can be determined from the technical data of the once-through steam generator 2.

Figure 3:
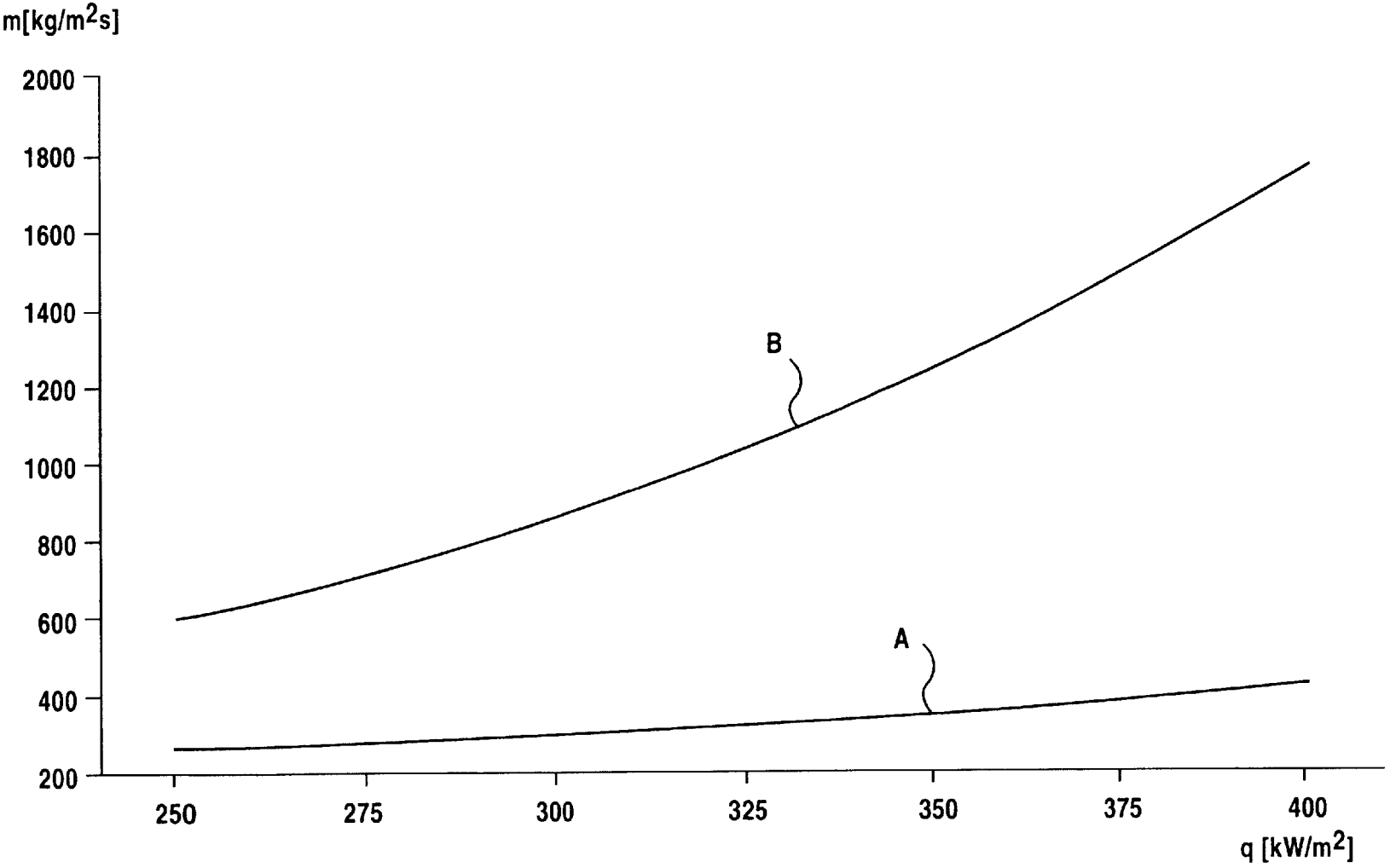
FIG. 3 is a graph with characteristic lines A and B for a mass flow density as a function of a heat flow density for the evaporator tubes.

In this case, a characteristic value for the mass flow density m as a function of the heat flow density q is obtained as a configuration criterion for the once-through steam generator 2, as illustrated graphically in FIG. 3 for various tube geometries and various tube materials. In this case, the characteristic line A describes that mass flow density in $kg/m^2s$ that is obtained, in the case of a geometry parameter $$[d/(d-2s)]s^2 \text{ of } 4\cdot10^{-5}m^2,$$

for an admissible maximum temperature $T_{max}$ of 590° C. In this case, the value of about 590° C., taken as a basis for the admissible maximum temperature $T_{max}$, is relevant to a once-through steam generator 2, the evaporator tubes 12 of which are manufactured from the material HCM 12. The characteristic line B represents the particularly advantageous mass flow density m as a function of the heat flow density q for a once-through steam generator 2, the evaporator tubes 12 of which have a geometry parameter $$[d/(d-2s)]s^2 \text{ of } 10^{-4}m^2$$

and an admissible maximum temperature $T_{max}$ of about 515° C. In this case, the admissible maximum temperature $T_{max}$ of 515° C. is relevant to the evaporator tubes 12 made from the material 13 CrMo 44.

In general, a value determined according to the relation $$T_{max}=T_{crit}+6\sigma/(\beta\cdot E)$$

is taken as a basis for the admissible maximum temperature $T_{max}$ for any desired evaporator tube 12. In this case, $T_{crit}$ is the temperature of the flow medium S at the critical pressure $P_{crit}$ in °C., σ is the admissible stress of the material of the evaporator tube 12 in $N/mm^2$, β is the coefficient of thermal expansion of the material of the evaporator tube 12 in l/K, and E is the modulus of elasticity of the material of the evaporator tube 12 in $N/mm^2$.

We claim:

1. A method for operating a once-through steam generator having a combustion chamber with a containing wall formed from vertically disposed evaporator tubes welded to one another in a gas-tight manner, which comprises:

conducting a flow medium through the evaporator tubes having a tube outside diameter d, a tube-wall thickness s, and an admissible maximum temperature $T_{max}$ defined by a material forming the evaporator tubes; and maintaining a mass flow density m of the flow medium flowing through the evaporator tubes as a function of a heat flow density q acting on the evaporator tubes, approximately at a control value according to the relation:

$$m=200+8.42\cdot10^{12}\cdot q^3\cdot[d/(d-2s)]s^2\cdot T_{max}^{-5},$$

where d signifies the tube outside diameter of the evaporator tubes in meters, s the tube-wall thickness of the evaporator tubes in meters, $T_{max}$ the admissible maximum temperature in °C. being characteristic of the material forming the evaporator tubes, and q the heat flow density in $kW/m^2$.

2. The method according to claim 1, which comprises taking a value determined according to the relation $$T_{max}=T_{crit}+6\sigma/(\beta\cdot E)$$

as a basis for the admissible maximum temperature $T_{max}$, $T_{crit}$ being a temperature of the flow medium at a critical pressure $P_{crit}$, σ (in $N/mm^2$) being an admissible stress, β(1/K) being a coefficient of thermal expansion, and E (in $N/mm^2$) being a modulus of elasticity of the material forming the evaporator tubes.

3. The method according to claim 1, which comprises using 13 CrMo 44 as the material forming the evaporator tubes, and a value of about $T_{max}$=515° C. being taken as a basis for the admissible maximum temperature.

4. The method according to claim 1, which comprises using HCM 12 as the material forming the evaporator tubes, and a value of about $T_{max}$=590° C. being taken as a basis for the admissible maximum temperature.

5. The method according to claim 1, which comprises defining a value of the heat flow density as a product of a maximum heat flow density and a safety factor.

6. A once-through steam generator system, comprising:

a combustion chamber having a containing wall formed from vertically disposed evaporator tubes welded to one another in a gas-tight manner and formed of a tube material, said evaporator tubes having an outside diameter d, a tube-wall thickness s, an admissible maximum temperature $T_{max}$ defined by said tube material forming said evaporator tubes, and an interior with a surface structure formed thereon, said interior of said evaporator tubes conducting a flow medium; and said combustion chamber configured for having a mass flow density m of the flow medium conducted in said evaporator tubes being a function of a heat flow density q acting on said evaporator tubes according to the relation:

$$m=200+8.42\cdot10^{12}\cdot q^3\cdot[d/(d-2s)]s^2\cdot T_{max}^{-5}$$

where d signifies the tube outside diameter of the evaporator tubes in meters, s the tube-wall thickness of the evaporator tubes in meters, $T_{max}$ the admissible maximum temperature in ° C. being characteristic of the material forming the evaporator tubes, and q the heat flow density in $kW/m^2$, wherein a value of the heat flow density is a product of a maximum heat flow density and a safety factor.

7. The once-through steam generator according to claim 6, wherein said tube material forming said evaporator tubes is 13 CrMo 44 and the admissible maximum temperature $T_{max}$ is 515° C.

8. The once-through steam generator according to claim 6, wherein said tube material forming said evaporator tubes is HCM 12 and the admissible maximum temperature $T_{max}$ is 590° C.

* * * * *